United States Patent [19]

Pyle

[11] 4,232,715

[45] Nov. 11, 1980

[54] COAXIAL VAPOR RECOVERY NOZZLE

[75] Inventor: Walter R. Pyle, Richmond, Calif.

[73] Assignee: Chevron Research Company, San Francisco, Calif.

[21] Appl. No.: 974,190

[22] Filed: Dec. 28, 1978

[51] Int. Cl.[3] ..... B65B 3/18

[52] U.S. Cl. ..... 141/1; 141/208; 141/292; 141/293; 141/302; 141/305; 141/311 R

[58] Field of Search ..... 141/1, 46, 52, 59, 93, 141/97, 198, 206-229, 285, 287, 290, 292, 293, 301, 302, 305, 311 R, 392

[56] References Cited

U.S. PATENT DOCUMENTS

| | | | |
|---|---|---|---|
| 3,581,782 | 6/1971 | Onufer | 141/59 |
| 4,058,149 | 11/1977 | Hansel | 141/301 |
| 4,060,108 | 11/1977 | Weston et al. | 141/59 |
| 4,060,110 | 11/1977 | Bower | 141/207 |
| 4,131,141 | 12/1978 | Weissenbach | 141/292 X |
| 4,166,485 | 9/1979 | Wokas | 141/207 X |

OTHER PUBLICATIONS

A.P.I. Publication No. 4306 "On-Board Control of Vehicle Refueling Emissions", Oct. 1978.

A.P.I. Publication No. 4222 "Vehicle Refueling Emissions Seminar", p. 12, Dec. 1973.

*Primary Examiner*—Frederick R. Schmidt

*Attorney, Agent, or Firm*—J. A. Buchanan, Jr.; R. L. Freeland, Jr.

[57] ABSTRACT

A vapor-recovery system in which a coaxial vapor-recovery fuel dispensing nozzle cooperates with portions of the vehicle fuel receiving and storage system to prevent the escape of vapors into the atmosphere during refueling. The fuel-dispensing nozzle comprises a rigid, tubular vapor-recovery member coaxially arranged around the nozzle discharge spout to define a vapor-recovery passageway therebetween. A seal means is located inwardly of the fuel tank fillpipe opening to sealingly engage the vapor-recovery member when the nozzle discharge spout is operatively inserted into the fillpipe so that substantially all refueling emissions will flow into the vapor-recovery passageway of the vapor-recovery member. The coaxial vapor-recovery nozzle also includes a vapor seal valve operable by the fuel pressure available in the nozzle to seal the outer end of the vapor-recovery member when the nozzle is not in use, and to open the outer end of the vapor-recovery member when the nozzle discharge spout is operatively inserted into the fillpipe and the fillpipe seal means sealingly engages the vapor-recovery member. The nozzle further includes a no-seal, no-flow interlock for preventing the nozzle from dispensing fuel until the fillpipe seal means sealingly engages the vapor-recovery member, the no-seal, no-flow interlock opening and closing with the opening and closing of the vapor seal valve.

25 Claims, 12 Drawing Figures

COAXIAL VAPOR RECOVERY NOZZLE

FIELD OF THE INVENTION

The present invention relates to vapor-recovery fuel dispensing systems, and more particularly, to fuel dispensing nozzles designed to cooperate with portions of a vehicle fuel receiving and storage system to prevent the escape of vapors into the atmosphere during refueling.

BACKGROUND OF THE INVENTION

In an attempt to reduce hydrocarbon emissions, environmental regulations in certain areas of the country require that fuel vapors are to be recovered in order to prevent their escape into the atmosphere. One means of complying with these regulations is the use of fuel nozzle assemblies incorporating vapor-recovery systems of the type described in U.S. Pat. No. 4,060,110 (Bower). Vapor-recovery fuel dispensing nozzles of this type generally include a flexible vapor-recovery shroud positioned around the nozzle discharge spout, a faceplate connected at the outer end of the shroud, and spring means located in the shroud and arranged around the discharge spout so that the faceplate is forced to sealingly engage the fuel tank fillpipe when the discharge spout is inserted therein during refueling. As fuel is pumped into the fuel tank, fuel vapors flow out of the tank and by way of the shroud to a vapor-receiving passage formed in the nozzle main body portion. From the vapor-receiving passage, the refueling vapor emissions flow through a vapor return line to a hydrocarbon storage tank at the service station where they are stored pending their removal. To operate effectively, these vapor-recovery fuel dispensing nozzles are also provided with some type of vapor seal valve or control system to prevent vapors in the storage tank from being displaced into the atmosphere through the shroud when the nozzle is not in use; additionally, these nozzles will normally include a no-seal, no-flow interlock which prevents the nozzle from operating until its faceplate seals against the fillpipe.

An alternate to the above-described vapor-recovery system which eliminates the necessity of using a service station vapor-recovery fuel dispensing nozzle is an on-board system for controlling refueling vapor emissions. Basically, this system, which is described in API Publication No. 4306, "On-Board Control of Vehicle Refueling Emissions—Demonstration of Feasibility", October 1978, is a modified version of current automobile evaporative control systems in which hydrocarbons are absorbed by activated charcoal contained in a carbon canister located on the vehicle. In the on-board control system, a sealing means is provided in the fillpipe to form a vapor-tight seal around the nozzle discharge spout so that refueling vapors will flow from the fuel tank to the vehicle's carbon canister where they are absorbed and subsequently purged to flow to the engine's carburetor or intake manifold. Studies of various seal types to be used in the fillpipe at the discharge spout/fillpipe interface, see API Publication No. 4306, part entitled "Report on Nozzle/Fillpipe Interface Development", have shown that a 99+% effective seal may be made around the discharge spout at its interface with the fillpipe. This may be compared to the 90–95% effective seal made with the vapor-recovery fuel dispensing nozzles of the type described above wherein the nozzle faceplate seals against the fillpipe.

Cost comparisions of the two above-discussed vapor-recovery systems have shown that their individual, overall costs are approximately the same, see API Publication No. 4306, part entitled "Cost Comparison for Stage II and On-Board Control of Refueling Emissions", wherein with the service station vapor-recovery fuel dispensing nozzle, the cost is essentially borne by the gasoline retailers in that they must buy and install the vapor-recovery fuel dispensing nozzle system, while with the on-board vapor control system, it is the automobile manufacturer who must bear the economic burden of complying with vapor control regulations. To distribute the costs of recovering refueling emissions between the automobile manufacturers and gasoline retailers, a vapor-recovery system could be designed to use a vapor-recovery nozzle that is less complex and costly than that of the type described in U.S. Pat. No. 4,060,110 in which the nozzle is to be sealingly engaged at the fillpipe interface by a sealing means that is manufactured as a part of and located in the fuel tank fillpipe.

A design proposed heretofore for a vapor-recovery system which can be said to be directed to this idea of distributing cost between automobile manufacturers and gasoline retailers is shown in API Publication No. 4222, "Vehicle Refueling Emissions Seminar", page 12, "An Automobile Industry Viewpoint", December 1973. The vapor-recovery system shown in this report includes a concentric spout extending a short distance from the main body of the fuel nozzle and arranged around the nozzle discharge spout to be sealingly engaged by a tight fillpipe connection of some sort at the opening of the fillpipe such that refueling emissions will flow out of the fuel tank by way of the concentric spout. This system, however, is not really a workable concept in that it lacks several important qualifications necessary for effective operation in meeting the requirements of current vapor emission regulations. First, the cross-sectional area of the vapor-recovery chamber formed by the concentric spout is too small to receive substantially all the vapors that will be produced during a typical refueling; this is a problem because the vapors which are not recovered will drive the pressure up in the fuel tank which will cause the seal made at the concentric spout to leak, and in extreme cases, it may even cause the fuel tank to buckle. Therefore, this system lacks the basic requirement that all vapor-recovery systems must possess in that it does not provide a vapor-tight seal at the discharge spout/fillpipe interface to minimize the escape of hydrocarbons into the atmosphere. Second, the system disclosed in API Publication 4222 does not have a vapor seal valve or some type of control system for preventing recovered vapors in the storage tanks from being displaced into the atmosphere through the vapor-receiving apparatus, the concentric spout, when the nozzle is not in use. Finally, this system does not have a no-seal, no-flow interlock which prevents the nozzle from operating until a seal is made at the discharge spout/fillpipe interface.

Accordingly, the coaxial vapor-recovery nozzle of the present invention, which includes a vapor seal valve and a no-seal, no-flow interlock, provides a workable vapor-recovery system which distributes the cost of recovering refueling emissions between the automobile manufacturers and the gasoline retailers while at the same time providing a system which provides a virtually vapor-tight seal, approximately 99+%, at the discharge spout/fillpipe interface. The present invention also offers the advantage of reducing the over-all complexity of the vapor-recovery fuel dispensing nozzle by doing away with the flexible vapor-recovery shroud, the faceplate, and the various spring means used on most commercially available vapor-recovery fuel dispensing nozzles; this has the effect of reducing the cost of the nozzles and the breakdown problems associated with their use. The present invention also eliminates the need for using an on-board carbon canister system and thus the problems and costs associated with its development into a commercially viable system.

SUMMARY OF THE INVENTION

In accordance with the present invention, a vapor-recovery system is provided in which a coaxial vapor-recovery fuel dispensing nozzle cooperates with portions of a vehicle fuel receiving and storage system to prevent the escape of refueling emissions into the atmosphere. The fuel dispensing nozzle of the present invention comprises a rigid, tubular, vapor-recovery member projecting from the nozzle main body portion and coaxially arranged around the nozzle discharge spout to define a vapor-recovery passageway therebetween. The inner end of the vapor-recovery member is in communication with a vapor-receiving passage formed in the nozzle main body portion, and the outer end of the vapor-recovery member is located inwardly of the outlet end of the discharge spout to be proportioned for insertion into a seal means located in the fuel tank fillpipe of the vehicle fuel receiving and storage system. The fillpipe seal means is designed to sealingly engage the vapor-recovery member to establish a vapor-tight seal therewith when the nozzle discharge spout is operatively inserted into the fillpipe so that substantially all the vapor expelled from the fuel tank during refueling flows through the vapor-recovery member to the vapor-receiving passage formed in the nozzle main body portion.

The coaxial vapor-recovery nozzle of the present invention also includes a vapor seal valve which is located in the vapor-recovery passageway inwardly of the outer end of the vapor-recovery member. When the nozzle is not in use, the vapor seal valve, which is operable by the fuel pressure available in the nozzle, is closed to prevent the escape of vapors located inwardly thereof through the outer end of the vapor-recovery member. When the nozzle discharge spout is operatively inserted into the fillpipe and the fillpipe seal means sealingly engages the vapor-recovery member, the vapor seal valve is open so that vapor expelled from the fuel tank during refueling may be directed through the vapor-recovery member to the vapor-receiving passage formed in the nozzle main body portion.

To operate the vapor seal valve, which is preferably a pinch valve, an actuating means is provided to operatively establish fluid communication between the vapor seal valve and the nozzle flow passage upstream of the nozzle flow control valve so that when the nozzle is not in use a fluid pressure is supplied to the vapor seal valve to close it. When the nozzle discharge spout is operatively inserted into the fillpipe and the fillpipe seal means sealingly engages the vapor-recovery member, an actuating plunger of the actuating means contacts the fillpipe causing fluid communication to be established between the vapor seal valve and the flow passage in the discharge spout so that fuel will flow from the vapor seal valve and into the flow passage in the discharge spout to open the vapor seal valve.

The vapor-recovery nozzle of the present system further includes a no-seal, no-flow interlock for preventing fuel from being dispensed by the nozzle until the fillpipe seal means sealingly engages the nozzle vapor-recovery member. The no-seal, no-flow interlock system is to operate in conjunction with the vapor seal valve so that when the vapor seal is closed when the nozzle is not in use, the interlock system disrupts normal venting of the vacuum-operated release mechanism to prevent the nozzle from dispensing fuel. Likewise, when the vapor seal valve is open, the interlock system permits normal venting of the vacuum-operated release mechanism so that fuel may be dispensed by the nozzle until at least the level of fuel in the tank being refueled rises to a level sufficient to block the end of the vent tube of the vacuum-operated release mechanism.

PRINCIPAL OBJECT OF THE INVENTION

A particular object of the present invention is to provide a vapor-recovery fuel dispensing system which cooperates with portions of the vehicle fuel receiving and storage system wherein a seal means is positioned in a fillpipe to sealingly engage a rigid vapor-recovery member that is coaxially arranged around the discharge spout of the nozzle to receive the refueling emissions, the nozzle of this system including a no-seal, no-flow interlock and a vapor seal valve.

Additional objects and advantages of the invention will become apparent from a detailed reading of the specification and drawings which are incorporated herein and made a part of this specification.

BRIEF DESCRIPTION OF THE DRAWINGS

FIGS. 5A–5C, inclusive, show various shaped sealing means which may be arranged around the vapor-recovery member of the fuel dispensing nozzle of FIG. 1;

DESCRIPTION OF THE PREFERRED EMBODIMENT

Figures 1, 2:
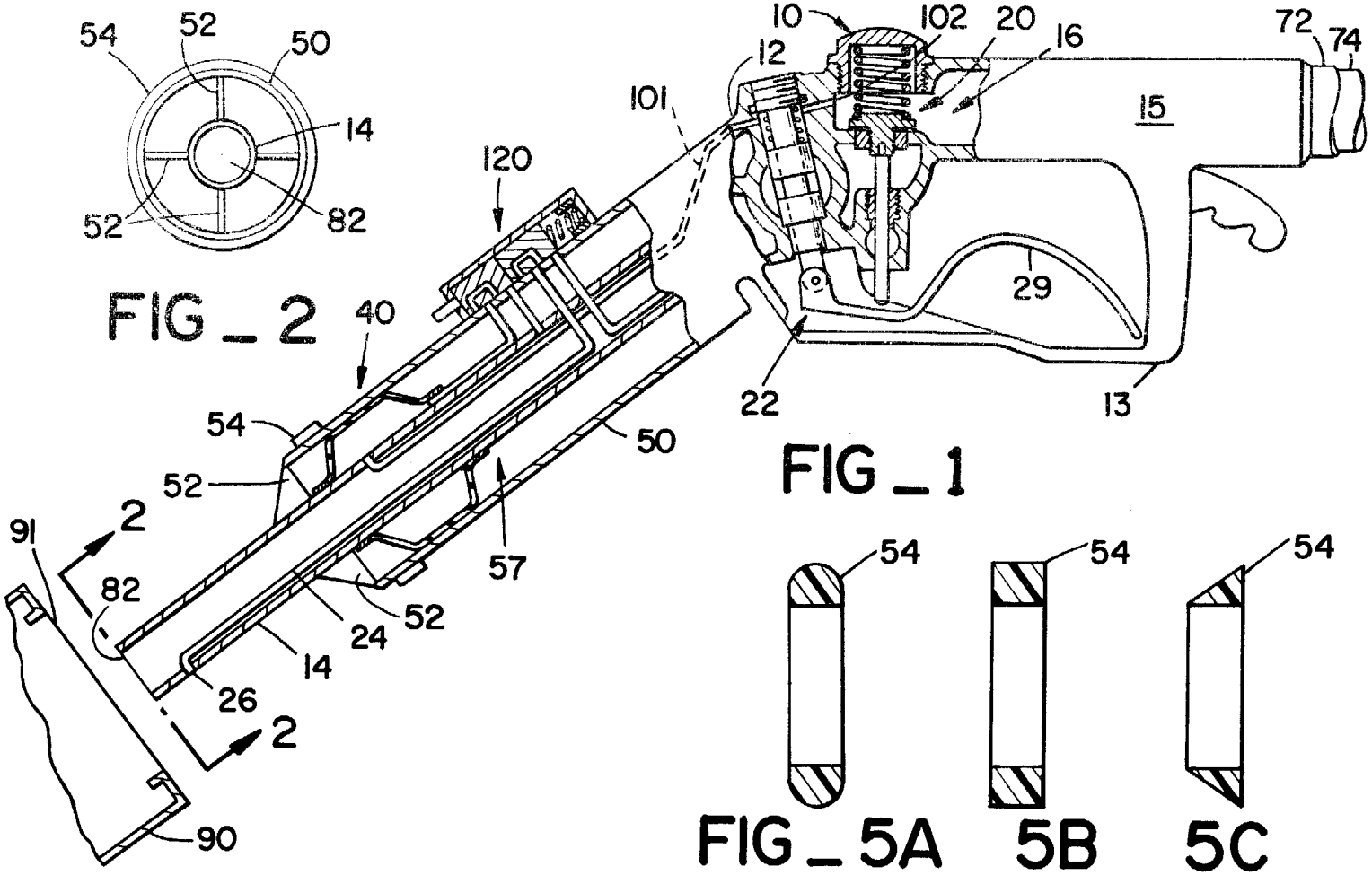
FIG. 1 is a longitudinal sectional view of the coaxial vapor-recovery fuel dispensing nozzle of the present invention.
FIG. 2 is an enlarged end view along line 2—2 in FIG. 1.

Referring to the drawings, FIG. 1 represents a coaxial vapor-recovery fuel dispensing nozzle 10 of the present invention having a main body portion 12 with an open-ended discharge spout 14 projecting from the nozzle main body portion for insertion into a fillpipe 90 of a vehicle fuel tank. The discharge spout has an outlet end 82 proportioned for ease of insertion into the fillpipe opening 91. A liquid flow passage, indicated generally by numeral 16, is provided for flowing fuel from a fuel dispenser, which is not illustrated, by means of fuel hose 72 to and through the nozzle main body portion 12 and the discharge spout 14.

A flow control valve, indicated generally by reference numeral 20, is located in the nozzle main body portion in flow passage 16 for opening and closing the passage to regulate the flow of fuel through the passage. Flow control valve 20 may be actuated by squeezing lever 29 of the releasable latching mechanism, identified generally by reference numeral 22, in the direction toward handle 15. A guard 13 acts to protect lever 29 as well as to provide a support for holding the nozzle when it is stored in the fuel dispenser when not in use.

The nozzle may also have a vacuum-operated release mechanism for automatically closing flow control valve 20 when the level of fuel in the tank being filled reaches the end of the discharge spout. For this purpose, as is well known in the art, a vent tube 24 forming a vent passage extends through discharge spout 14 with an opening or port 26 formed at one end thereof through the lower surface of the discharge spout near its outlet end 82. The opposite end of vent tube 24 is in communication with one of the chambers of the vacuum mechanism or shut-off diaphragm, not illustrated. This chamber is also in communication with a venturi arrangement so that the flow of fuel creates a vacuum on one side of the diaphragm which is relieved by having vent tube 24 open by means of port 26. However, when normal venting of the vacuum mechanism by way of vent tube 24 is interrupted, which may occur when the level of fuel in the tank being filled rises to a level sufficient to block port 26, the vacuum from the venturi causes the shut-off diaphragm to automatically operate releasable latching mechanism 22 to close valve 20 so that fuel can no longer be dispensed.

The vapor-recovery system of the present invention includes a rigid, tubular member 50 projecting from the nozzle main body portion 12 and coaxially positioned around discharge spout 14 of nozzle 10. The inner end of vapor-recovery member 50 is in contact with nozzle main body portion 12 where member 50 is either cast as part of the nozzle main body portion or manufactured as a separate unit and secured by any appropriate means to the nozzle main body portion. In this respect and considering that member 50 needs to be rigid to establish a vapor-tight seal with fillpipe seal means 60, as will be discussed in detail below, see FIGS. 3A-3C and FIG. 4, member 50 is preferably fabricated from the same material, usually aluminum, that discharge spout 14 is made of. A plurality of rib-like projections 52 may also be provided to support vapor-recovery member 50 on discharge spout 14; as illustrated in FIG. 2, these projections extend down from the inner surface of member 50 at the outer end thereof to the exterior surface of discharge spout 14 where they are affixed by any appropriate means.

A vapor-recovery passageway, indicated generally by reference numeral 57, having a sufficient cross-sectional area to receive substantially all the vapors produced during a typical refueling, is formed between the inner surface of member 50 and the exterior surface of discharge spout 14 to extend through vapor-recovery member 50 so that at the inner end thereof it is in communication with the vapor-receiving passage, which is not illustrated, formed in the nozzle main body portion 12, the vapor-receiving passage in the nozzle main body portion being in communication at its opposite end with a vapor-return line 74 which is connected between the nozzle 10 and the service station's hydrocarbon storage tank. The outer end of vapor-recovery member 50 is located inwardly of outlet end 82 of discharge spout 14, and it may be located in close proximity to outlet end 92 to assure that seal means 60, as will be discussed below, sealingly engages member 50. Like outlet end 82, the outer end of member 50 is proportioned for ease of insertion into opening 91 of fillpipe 90, and it may also be tapered in a direction toward outlet end 92 to facilitate insertion of member 50 into fillpipe seal means 60.

Figure 3A:
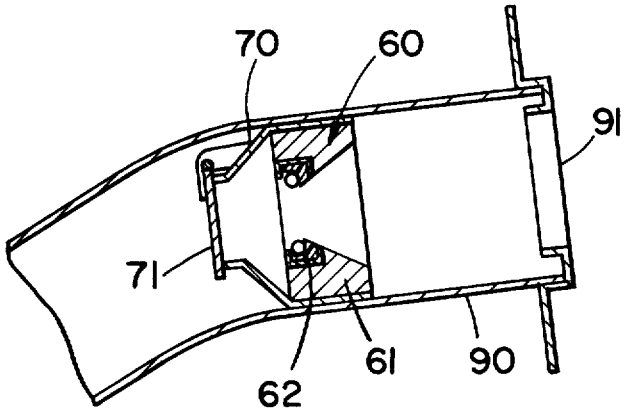
FIG. 3A is a schematic view illustrating a fillpipe seal means of the rotary seal type for sealingly engaging the vapor-recovery member of the fuel dispensing nozzle of FIG. 1.
Figure 3B:
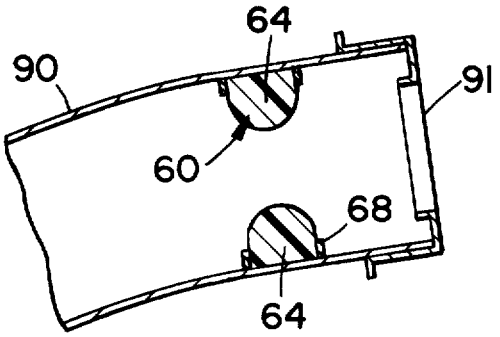
FIG. 3B is a schematic view illustrating a fillpipe seal means of the doughnut seal type for sealingly engaging the vapor-recovery member of the fuel dispensing nozzle of FIG. 1.
Figure 3C:
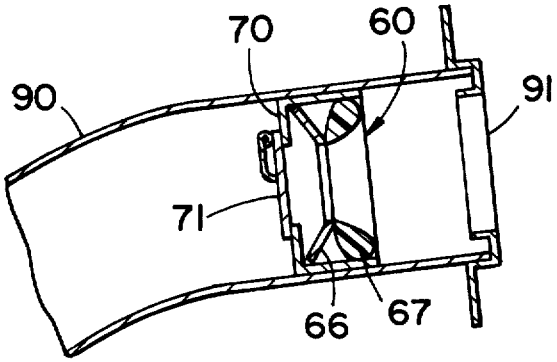
FIG. 3C is a schematic view illustrating a fillpipe seal means of the conical seal type for sealingly engaging the vapor-recovery member of the fuel dispensing nozzle of FIG. 1.
Figure 4:
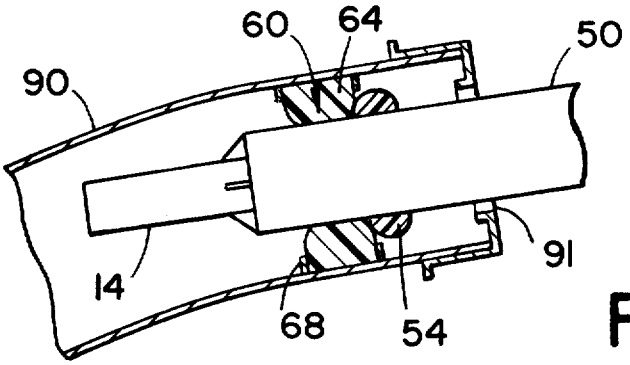
FIG. 4 is a schematic view illustrating the coaxial vapor-recovery fuel dispensing nozzle of FIG. 1 operativly inserted into the fuel tank fillpipe in sealing relationship with the seal means of FIG. 3B.

As illustrated in FIGS. 3A-3C, fillpipe seal means 69 may be one of several types of seals each of which are located in fillpipe 90 inwardly of the fillpipe opening 91 to sealingly engage vapor-recovery member 50 when the nozzle is operatively inserted into the fillpipe during refueling. The discharge spout and member 50, which is coaxially arranged around the discharge spout, form an integral unit which is proportioned for ease of insertion into fillpipe opening 91 and seal means 60 such that member 50 is sealingly engaged by seal means 60 to establish a virtually vapor-tight seal therebetween so as to prevent the escape of fuel vapors into the atmosphere during refueling. With the fillpipe seal means sealingly engaging vapor-recovery member 50 when the nozzle is operatively inserted into the fillpipe, as shown in FIG. 4, substantially all the vapor displaced from the fuel tank during refueling will be carried back into vapor-recovery passageway 57 from which it will flow into the vapor-receiving passage in nozzle main body portion 12, and from there the vapor will flow through vapor-recovery line 74 to an appropriate storage tank.

In selecting an appropriate seal for seal means 60, various factors had to be considered; for example, the seal had to provide a vapor-tight seal that was resistant to wear and temperature variations over the expected life of the vehicle, and the seal material itself had to be resistant to shrinkage and swell when exposed to fuel and fuel vapors. For a more detailed description of the different seal types to be discussed below see API Publication No. 4306, referred to above.

In FIG. 3A, a seal means 60 of the rotary seal type 62 is illustrated. These seals are well known in the art, and a model that is suitable for use with the present invention is Chicago Rawhide Industries, Seal Model 7538, which has a seal material made from a special compounded nitrile that is resistant to hydrocarbons. This seal means includes a metal guide 61 which is located inwardly of fillpipe opening 91 to assist in centering spout 14 and member 50 in the seal so that a vapor-tight seal is formed between member 50 and the seal. If the coaxial nozzle of the present invention is to be used for dispensing leadfree fuel, a lead restrictor 70 and trap door 71, which are located to the rear of seal means 60, would also have to be provided, as is known in the art, to prevent the dispensing of leaded fuel into the fuel tank.

Studies of the sealing effectiveness of the rotary seal in engaging a nozzle discharge spout have shown that a 99+% effective seal is made, see API Publication No. 4306, in preventing refueling vapor emissions from escaping into the atmosphere. The same sealing effectiveness would be expected to be achieved with the present invention wherein this seal sealingly engages vapor-recovery member 50. Two other types of seals which should be as effective in controlling refueling emissions and which can be used with the present invention are the doughnut seal 64, see FIG. 3B, and the conical seal 66, see FIG. 3C. The doughnut seal 64, as with the other seals, sealingly engages member 50, see FIG. 4, to provide a vapor-tight seal at the interface of the nozzle and the fillpipe. Seal 64 is positioned in the fillpipe by means of retainer rings 68 to be located inwardly of the fillpipe opening 91.

Conical seal 66, prior to insertion of the discharge spout into the fillpipe, has an inside diameter which is greater than the outside diameter of vapor-recovery member 50. When the discharge spout is inserted into the fillpipe, the tapered shapes of pressure discs 67 act to center spout 14 and member 50 in the disc opening so that they freely move through lead restrictor 70, if provided, to open trap door 71. To cause conical seal 66 to sealingly engage vapor-recovery member 50, a discharge spout sealing means 54 is located on member 50, see FIG. 1, inwardly of the outer end thereof to extend radially outwardly therefrom. As the nozzle advances into the fillpipe, seal means 54 comes into contact with pressure discs 67 causing conical seal 66 to be compressed against member 50 and lead restrictor 70, or any other suitable surface designed to receive seal 66, so that the seal sealingly engages member 50 to provide a vapor-tight seal therewith.

Sealing means 54 may have any shape, such as circular, FIG. 5A, rectangular, FIG. 5B, or wedge-shaped, FIG. 5C, that is appropriate for contacting discs 67 so that the discs cause seal 66 to be compressed against member 50. Sealing means 54, as illustrated in FIG. 4, may also be used with the other two described seal types for the purpose of assuring that an effective vapor-tight seal is made at vapor-recovery member 50.

Figure 7:
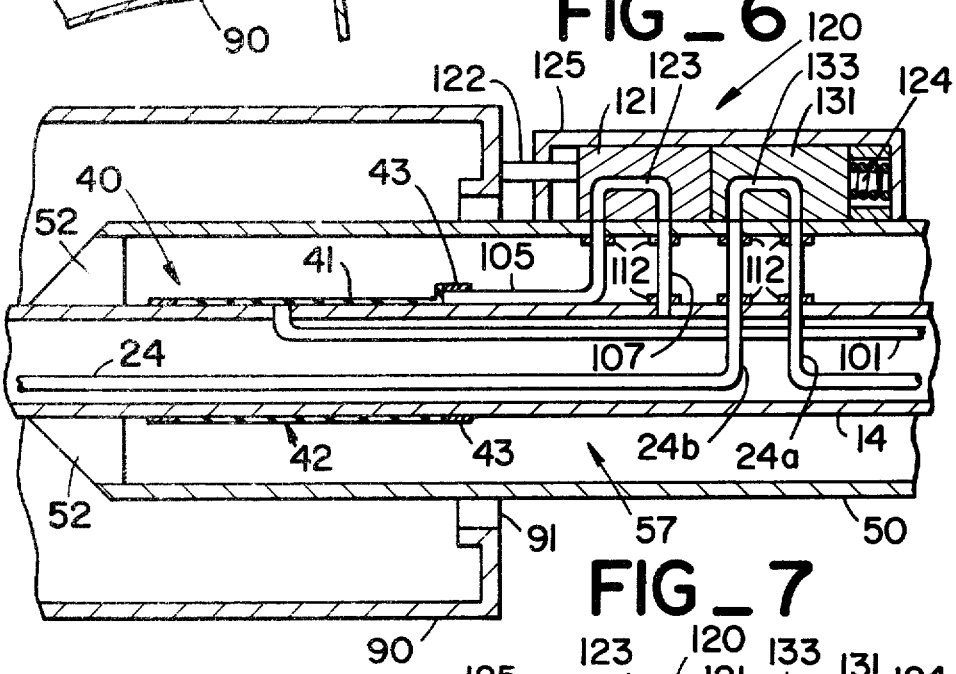
FIG. 7 is an enlarged view illustrating in greater detail the vapor seal valve and the no-seal, no-flow interlock of FIG. 1 in their open positions.
Figure 8:
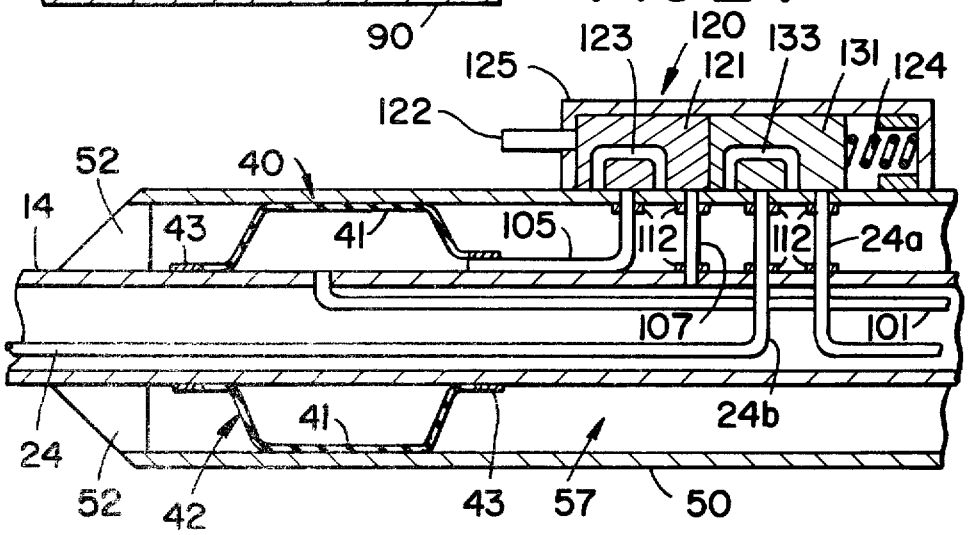
FIG. 8 is an enlarged view illustrating in greater detail the vapor seal valve and the no-seal, no-flow interlock of FIG. 1 in their closed positions.

For effective operation in complying with current vapor-control regulations, the coaxial nozzle of the vapor-recovery system of the present invention should also include a vapor seal valve for preventing recovered vapors stored in the hydrocarbon storage tank from escaping into the atmosphere, and a no-seal, no-flow interlock which prevents fuel from being dispensed unless seal means 60 sealingly engages vapor-recovery member 50. As shown in FIGS. 1, 7 and 8, the vapor seal valve, indicated generally by reference numeral 40, essentially comprises a pinch valve 42 located in the annular space or fluid passageway 57 defined by vapor-recovery member 50 and discharge spout 14, the pinch valve being positioned inwardly of projections 52 to provide a vapor-tight seal in this annular space to prevent the escape of recovered vapors through the outer end of member 50.

As is known in the art, the pinch valve may generally consist of a resilient sleeve 41 arranged within the vapor-recovery passageway 57 and secured therein by means of retainer rings 43, such that there is a fuel-tight annular space formed between the outer surface of the discharge spout and resilient sleeve 41. A pinch valve is designed to open and close by the action of air or hydraulic pressure acting on the resilient sleeve wherein the pressure is applied to the annular space formed between the sleeve and the outer surface of the discharge spout. In the present invention, pinch valve 42 is preferably operated by the fuel pressure available in the nozzle. When vapor seal valve 40 is closed, as shown in FIG. 8, sleeve 41 of pinch valve 42 sealingly engages the interior surfaces of vapor-recovery member 50 to provide a vapor-tight seal which prevents the escape of recovered fuel vapors through the outer end of member 50 when the nozzle is not in use. The resilient sleeve of pinch valve 42, like that of the fillpipe seal, should be fabricated from a material, such as buna-n, that is resistant to deterioration, shrinkage and swell when exposed to fuel vapors.

As discussed hereinabove, a fuel hose 72 connects the nozzle to the fuel dispenser which supplies fuel to the nozzle at a fluid pressure of approximately 30 psi (21,100 kg/m$^2$) such that this fuel pressure is available to actuate the vapor seal valve. To this purpose, a fluid passageway 101 is provided to establish fluid communication between pinch valve 42 and flow passage 16 upstream of flow control valve 20. Fluid passageway 101 extends from a port 102 in nozzle main body portion 12 and through the nozzle main body portion and the discharge spout to pinch valve 42 to establish fluid communication between pinch valve 42 and flow passage 16 upstream of flow control valve 20 to flow fuel from flow passage 16 to pinch valve 42 at a fluid pressure of approximately 30 psi (21,100 kg/m$^2$). That portion of fluid passageway 101 extending through nozzle main body portion 12 can either be cast or machined in the main body portion during fabrication of the nozzle. Likewise, that part of fluid passageway 101 extending through the discharge spout may be cast as part of the discharge spout, or it may be a fluid conduit that extends through the discharge spout or along the outer surface thereof.

A second fluid passageway 105 extends from pinch valve 42 and passes through the outer surface of vapor-recovery member 50, where a vapor-tight packing 112 is provided to prevent vapors from leaking into flow passage 16 in the discharge spout, to establish fluid communication with an actuating means, indicated generally by numeral 120. Actuating means 120 includes a valve member 121 longitudinally or slidably movable within a valve housing 125, wherein the housing is positioned on the outer surface of vapor-recovery member 50. Valve member 121 has an actuating plunger 122 affixed at one end thereof to face towards the outer end of member 50. A fluid channel 123, which is preferably U-shaped, is formed in valve member 121 for the purpose of establishing fluid communication between fluid passageway 105 and another fluid passageway 107 which is connected between actuating means 120 and flow passage 16 in the discharge spout. The points of entry of fluid passageways 105 and 107 into actuating means 120 are spaced an appropriate distance apart from one another so that they may be aligned with opposite ends of channel 123, see FIG. 7, to establish fluid communication between pinch valve 42 and flow passage 16 in the discharge spout. When the nozzle is not in use, a spring means 124 is provided to normally urge member 121 to a position wherein channel 123 is not in alignment, see FIG. 8, with fluid passageways 105 and 107, valve member 121 blocking the flow of fuel out of pinch valve 42.

Actuating plunger 122 extends through valve housing 125 and is of sufficient length to be in a position to contact the fillpipe when the nozzle discharge spout is operatively inserted therein and seal means 60 sealingly engages vapor-recovery member 50. When the discharge spout is operatively inserted into the fillpipe and seal means 60 sealingly engages member 50, actuating plunger 122 will contact the fillpipe to cause member 121 to move a sufficient distance in a direction away from the fillpipe opening, against spring means 124, so that channel 123 is aligned with fluid passageways 105 and 107. When channel 123 is in this position, fluid communication is established between pinch valve 42 and flow passage 16 in the discharge spout so that fuel will flow out of pinch valve 42 and into discharge spout 14 to open the pinch valve.

The no-seal, no-flow interlock or interlock system includes, see FIGS. 1, 7 and 8, a second valve member 131 longitudinally or slidably movable within valve housing 125 and connected in series, as illustrated, or in parallel, with valve member 123 to move in a like direction and in response to the movement of valve member 121. Valve member 131 could also be located in a second valve housing and affixed by any appropriate means to valve member 121 to move in response thereto. In any respect, a vent passage or channel 133, which is preferably U-shaped, is formed in valve member 131 to permit normal venting of the vacuum-operated release mechanism by way of vent passage opening 26. To explain more fully, vent tube 24 is divided into two sections 24*a* and 24*b* wherein vent tube section 24*a* extends from a chamber, as discussed heretofore, of the vacuum-operated release mechanism or diaphragm shut-off system to valve member 131, while vent tube section 24*b* extends from valve member 131 to the vent passage opening 26 at the outlet end of the discharge spout. Vent tube sections 24*a* and 24*b* enter valve housing 125 at points which are spaced an appropriate distance apart so that they may be in a position of alignment, see FIG. 7, with the opposite ends of vent channel 133 in valve member 131 to establish communication therebetween so that the vent passage through vent tube 24 is open to permit normal venting of the vacuum-operated mechanism. As with channel 123 in valve member 121, channel 133 is normally urged by spring means 124, which is affixed between valve housing 125 and that end of member 131 not connected to member 121, to a positiion of non-alignment with respect to vent tube sections 24*a* and 24*b*. In this position, the vent passage extending through vent tube 24 is blocked by valve member 131 to disrupt normal venting of the vacuum release mechanism which prevents the nozzleflow control valve from opening. The over-all structure and positioning of vent tubes 24*a* and 24*b*, fluid passageways 105 and 107, valve members 121 and 131, and channels 123 and 133 is such that when the nozzle discharge spout is operatively inserted in the fillpipe and seal means 60 sealingly engages vapor-recovery member 50, communication is established between fluid passageways 105 and 107 and between vent tube sections 24*a* and 24*b*. Likewise, when channel 123 is in a position of non-alignment with respect to fluid passageways 105 and 107, channel 133 is in a position of non-alignment with respect to vent tube sections 24*a* and 24*b*.

Operation of the vapor-recovery system of the present invention is apparent from the foregoing description. When the nozzle is not in use, with seal means 60 not sealingly engaging vapor-recovery member 50, vapor seal valve 40 is closed in that spring means 124 urges channel 123 in valve member 121 to a position of non-alignment, see FIG. 8, with respect to fluid passageways 105 and 107. In this position, fluid passageway 105 is blocked and fuel flows from flow passage 16 upstream of flow control valve 20, see FIG. 1, by means of port 102 and fluid passageway 101 to the annular space formed between pinch valve sleeve 41 and the exterior surface of the discharge spout, supplying a fluid pressure of approximately 30 psi (21,100 kg/m$^2$) to the annular space which causes sleeve 41 to inflate and close pinch valve 42. Likewise, when vapor-recovery member 50 is not sealingly inserted into seal means 60, channel 133 in valve member 131 is in a position of non-alignment, see FIG. 8, with respect to vent tube sections 24*a* and 24*b*. In this position, valve member 131 blocks vent tube sections 24*a* and 24*b* so that normal venting of the vacuum operated mechanism through the vent passage formed in vent tube 24 is disrupted which actuates the release mechanism to prevent the flow control valve 20 from opening which prevents fuel from being dispensed.

When discharge spout 14 is operatively inserted into fillpipe 90 and seal means 60 sealingly engages vapor-recovery member 50, the actuating plunger 122 has come into contact with the fillipe to force valve members 121 and 131 rearwardly against spring means 124 to a position wherein channel 123 is in alignment with fluid passageways 105 and 107 and channel 133 of the interlock system is in alignment with vent tube sections 24*a* and 24*b*. When channel 123 is aligned with fluid passageways 105 and 107, fluid communication is established between pinch valve 42 and flow passage 16 in the discharge spout so that the pinch valve and thus the vapor seal valve are open. To explain more fully, the pressure in the discharge spout is at approximately atmospheric pressure and the fuel supplied to pinch valve 42 flows at a pressure of approximately 30 psi (21,100 kg/m$^2$); therefore, when channel 123 is in this position of alignment, a pressure differential is established between fluid passageways 105 and 107 which causes fuel to flow from pinch valve 42 and through fluid passageways 105 and 107 into flow passage 16 in the discharge spout from which it flows through the outlet end of the discharge spout. It should be noted that it would be possible to size port 102, see FIG. 1, so that it has an opening that is sufficiently small so that when flow control valve 20 is open, very little fuel will flow into fluid passageway 101. Of course, any fuel that should flow through port 102 when channel 123 is aligned with fluid passageways 105 and 107 will flow through fluid passageways 101, 105 and 107 and channel 123 to flow passage 16 in the discharge spout. With respect to the interlock system, when communication is established between vent tube sections 24*a* and 24*b* by means of channel 133, the vent passage through vent tube 24 is open so that the vent system will operate in a normal manner to permit the flow of fuel through the nozzle until at least the level of fuel rises above vent passage opening 26 to actuate the vacuum-operated release mechanism and close flow control valve 20.

Figure 6:
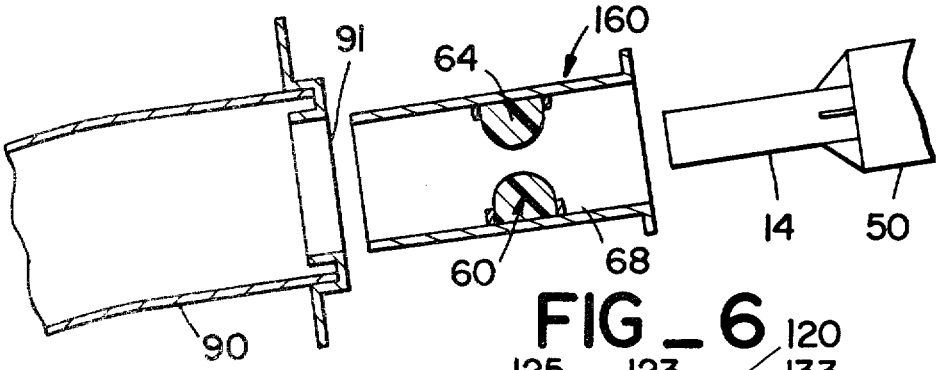
FIG. 6 is a schematic view illustrating a means for utilizing the fillpipe seal means of the types shown in FIGS. 3A–3C with a fuel tank fillpipe not originally manufactured with such fillpipe seal means.

It will be noted that seal means 60, as illustrated in FIG. 6, could be manufactured as a separate unit 160 to be retrofitted on fillpipes of existing vechicles not manufactured with the seal means assembled as part of the fillpipe. In such situations, seal means unit 160 would be adapted to fit the fillpipe to sealingly engage vapor-recovery member 50 of the nozzle. It should also be noted that valve housing 125 and actuating plunger 122 are to be sturdily constructed to resist impact during use of the nozzle. Finally, it is noted that it would be possible to use in place of the pinch valve of the vapor seal valve system some other type of valve which is operable by a fluid pressure.

SUMMARY OF THE ADVANTAGES

The vapor-recovery system of the present invention offers a system for distributing the costs of recovering refueling emissions between the automobile manufacturers and gasoline retailers while at the same time providing a relatively simple and effective system which has a vapor seal valve and no-seal, no-flow interlock.

Although certain specific embodiments of the invention have been described in detail, the invention is not to be limited to only such embodiments but rather by the appended claims.

What is claimed is:

1. A vapor-recovery system for vehicle refueling wherein a fuel-dispensing system cooperates with portions of a vehicle fuel receiving and storage system, comprising:

a fuel-dispensing nozzle having a main body portion, a discharge spout projecting from the main body portion, said discharge spout having an outlet end proportioned for ease of insertion into a fuel tank fillpipe of a vehicle fuel receiving and storage system, a flow passage for the flow of fuel to said nozzle and through said main body portion and said discharge spout, a flow control valve in said main body portion operable to regulate the flow of fuel through said flow passage, a vapor-receiving passage formed in said main body portion, a vapor-recovery, rigid, tubular member projecting from said main body portion and coaxially arranged around said discharge spout to define with the exterior surface of said discharge spout a vapor-recovery passageway therebetween for receiving vapors displaced from the vehicle fuel tank during refueling, said vapor-recovery member having an inner end and outer end, the inner end of said vapor-recovery member mounted on said main body portion and communicating with said vapor receiving-passage in said main body portion, the outer end of said vapor-recovery member located rearwardly of the outlet end of said discharge spout and proportioned for ease of insertion into the fuel tank fillpipe, a seal means located inwardly of the fuel tank fillpipe opening for receiving the outlet end of said discharge spout and the outer end of said vapor-recovery member to establish a vapor-tight seal with said vapor-recovery member when said discharge spout is operatively inserted in the fuel tank fillpipe so that substantially all the vapor expelled from the fuel tank during refueling flows through said vapor-recovery member to said vapor receiving passage in said main body portion, a valve means operable by a fluid pressure located in said vapor-recovery member inwardly of the outer end thereof to prevent the escape of vapors through the outer end of said vapor-recovery member, said valve means being in a closed position when said nozzle is not in use so that vapors located inwardly thereof cannot escape through the outer end of said vapor-recovery member and said valve means being in an open position when said nozzle is operatively inserted into the fuel tank fillpipe and said seal means sealingly engages said vapor-recovery member so that vapor expelled from the fuel tank during refueling may be directed through said vapor-recovery member to the vapor-receiving passage in said main body portion, and an actuating means for operating said valve means so that said valve means is closed when said nozzle is not in use and so that said valve means is open when said nozzle is operatively inserted into the fuel tank fillpipe and said seal means sealingly engages said vapor-recovery member.

2. A vapor-recovery system for vehicle refueling wherein a fuel-dispensing system cooperates with portions of a vehicle fuel receiving and storage system, comprising:

a fuel-dispensing nozzle having a main body portion, a discharge spout projecting from the main body portion, said discharge spout having an outlet end proportioned for ease of insertion into a fuel tank fillpipe of a vehicle fuel receiving and storage system, a flow passage for the flow of fuel to said nozzle and through said main body portion and said discharge spout, a flow control valve in said main body portion operable to regulate the flow of fuel through said flow passage, a vapor-receiving passage formed in said main body portion, a vapor-recovery, rigid, tubular member projecting from said main body portion and coaxially arranged around said discharge spout, said vapor-recovery member having an inner end and outer end, the inner end of said vapor-recovery member mounted on said main body portion to communicate with said vapor-receiving passage in said main body portion, the outer end of said vapor-recovery member located rearwardly of the outlet end of said discharge spout and proportioned for ease of insertion into the fuel tank fillpipe, said vapor-recovery member defining with the exterior surface of said discharge spout a vapor-recovery passageway therebetween for receiving vapors displaced from the fuel tank during refueling, a seal means located inwardly of the fillpipe opening for receiving the outlet end of said discharge spout and the outer end of said vapor-recovery member to sealingly engage said vapor-recovery member when said discharge spout is operatively inserted in the fuel tank fillpipe so that substantially all the vapor expelled from the fuel tank during refueling flows through said vapor-recovery passageway defined by said vapor-recovery member and the exterior surface of said discharge spout to said vapor-receiving passage in said main body portion, a pinch valve operable by a fluid pressure located in said vapor-recovery member inwardly of the outer end thereof to prevent the escape of vapors through the outer end of said vapor-recovery member, said pinch valve being in a closed position when said nozzle is not in use so that vapors located inwardly thereof cannot escape through the outer end of said vapor-recovery member and said pinch valve being in an open position when said discharge spout is operatively inserted into the fuel tank fillpipe and said seal means sealingly engages said vapor-recovery member so that vapors expelled from the fuel tank during refueling may be directed through said vapor-recovery passageway defined by said vapor-recovery member and the exterior surface of said discharge spout to the vapor-receiving passage in said main body portion, and an actuating means for operatively establishing fluid communication between the flow passage upstream of said flow control valve and said pinch valve so that said pinch valve is closed when said nozzle is not in use and for establishing fluid communication between the flow passage in said discharge spout and said pinch valve so that said pinch valve is open when said discharge spout is operatively inserted into the fuel tank fillpipe and said seal means sealingly engages said vapor-recovery member.

3. The vapor-recovery system of claim 2 wherein said actuating means comprises a first fluid passageway connecting the flow passage upstream of said flow control valve with said pinch valve for flowing fuel from the flow passage upstream of said flow control valve to said pinch valve in order that a fluid pressure is supplied to said pinch valve to close said pinch valve, a first valve member having a fluid channel means formed therein and located in a valve housing mounted on said vapor-recovery member to be movable within said valve housing to operatively establish fluid communication between said pinch valve and the flow passage in said discharge spout, a second fluid passageway connecting said pinch valve and the flow passage in said discharge spout by way of said fluid channel means in said first valve member whereby fuel may flow from said pinch valve to the flow passage in said discharge spout to open said pinch valve, said first valve member movable between a first position in which said second fluid passageway is blocked to prevent fluid communication from being established between said pinch valve and the flow passage in said discharge spout so that said pinch valve is closed and a second position in which said second fluid passageway is open by way of said fluid channel means in said first valve member to establish fluid communication between said pinch valve and the flow passage in said discharge spout so that said pinch valve is open, and an actuating plunger affixed to said first valve member and extending through said valve housing to contact the fuel tank fillpipe to cause said first valve member to move to the open position when said discharge spout is operatively inserted into the fuel tank fillpipe and said seal means sealingly engages said vapor-recovery member, said first valve member moving to the closed position when said seal means does not sealingly engage said vapor-recovery member when said nozzle is not in use.

4. The vapor-recovery system of claim 3 wherein said nozzle further includes a vent tube extending from a vacuum-operated release mechanism to the outlet end of said discharge spout to form a vent passage therein, the vacuum-operated release mechanism automatically closing said flow control valve when the level of fuel in the fuel tank being refueled rises above a level sufficient to block the end of said vent passage of said vent tube at the outlet end of said discharge spout, a second movable valve member having a vent channel means formed therein and located in said valve housing to be connected to said first valve member to move within said valve housing in response to the movement of said first valve member, a portion of said vent passage of said vent tube formed by said vent channel means in said second valve member such that said second valve member is movable between a first position in which said vent passage is blocked by said second valve member to disrupt normal venting and activate the vacuum-operated release mechanism to close said flow control valve when said seal means does not sealingly engage said vapor-recovery member and a second position in which said vent passage is open by way of said vent channel means to permit normal venting of the vacuum-operated release mechanism when said discharge spout is operatively inserted in the fillpipe and said seal means sealingly engages said vapor-recovery member.

5. The vapor-recovery system of claim 4 wherein said seal means comprises a rotary seal positioned adjacent to and inwardly of a guide means, which is located inwardly of the fillpipe opening, for centering said vapor-recovery member in said rotary seal.

6. The vapor-recovery system of claim 4 wherein said seal means comprises a doughnut seal.

7. The vapor-recovery system of claim 4 further including a discharge spout sealing means secured to said vapor-recovery member rearwardly of the outer end thereof and disposed radially outwardly therefrom for sealingly engaging said seal means.

8. The vapor-recovery system of claim 7 wherein said seal means comprises a conical seal and pressure discs located outwardly of said conical seal for centering said vapor-recovery member therein and for contacting said conical seal when said discharge spout sealing means engages said pressure discs so that said conical seal compresses to sealingly engage said vapor-recovery member.

9. The vapor-recovery system of claims 7 or 8 wherein said discharge spout sealing means comprises an elliptically shaped seal.

10. The vapor-recovery system of claims 7 or 8 wherein said discharge spout sealing means comprises a ring-shaped seal.

11. The vapor-recovery system of claims 7 or 8 wherein said discharge spout sealing means comprises a wedge-shaped seal.

12. The vapor-recovery system of claim 2 wherein the outer end of said vapor-recovery member angles outwardly toward the outlet end of said discharge spout for ease of passage through said seal means.

13. A vapor-recovery system for vehicle refueling wherein a fuel-dispensing system cooperates with portions of a vehicle fuel receiving and storage system, comprising:

a fuel-dispensing nozzle having a main body portion, a discharge spout projecting from the main body portion, said discharge spout having an outlet end proportioned for ease of insertion into a fuel tank fillpipe of a vehicle fuel receiving and storage system, a flow passage for the flow of fuel to said nozzle and through said main body portion and said discharge spout, a flow control valve in the main body portion operable to regulate the flow of fuel through said flow passage, a vent tube extending from a vacuum-operated release mechanism to the outlet end of said discharge spout to form a vent passage therein, the vacuum-operated release mechanism automatically closing said flow control valve when the level of fuel in the fuel tank being refueled rises above a level sufficient to block the end of said vent passage of said vent tube at the outlet end of said discharge spout, a vapor-receiving passage means formed in said main body portion, a vapor-recovery, rigid, tubular member projecting from said main body portion and coaxially arranged around said discharge spout, said vapor-recovery member having an inner end and outer end, the inner end of said vapor-recovery member mounted on said main body portion to communicate with said vapor-receiving passage in said main body portion, the outer end of said vapor-recovery member located rearwardly of the outlet end of said discharge spout and proportioned for ease of insertion into the fuel tank fillpipe, said vapor-recovery member defining with the exterior surface of said discharge spout a vapor-recovery passageway therebetween for receiving vapors displaced from the vehicle fuel tank, a seal means located inwardly of the fillpipe opening of the vehicle receiving and storage system for receiving the outlet end of said discharge spout and the outer end of said vapor-recovery member to sealingly engage said vapor-recovery member when said discharge spout is operatively inserted in the fuel tank fillpipe opening so that substantially all the vapor expelled from the fuel tank during refueling flows through said vapor-recovery member to said vapor-receiving passage in said main body portion, a pinch valve operable by a fluid pressure located in said vapor-recovery member inwardly of the outer end thereof to prevent the escape of vapor through the outer end of said vapor-recovery member, said pinch valve being in a closed position when said nozzle is not in use so that vapors located inwardly thereof cannot escape through the outer end of said vapor-recovery member and said pinch valve being in an open position when said discharge spout is operatively inserted into the fuel tank fillpipe and said seal means sealingly engages said vapor-recovery member so that vapor expelled from the fuel tank during refueling may be directed through said vapor-recovery member to the vapor-receiving passage in said main body portion, a first fluid passageway connecting the flow passage upstream of said flow control valve with said pinch valve for flowing fuel from the flow passage upstream of said flow control valve to said pinch valve in order that a fluid pressure is supplied to said pinch valve to close said pinch valve when said nozzle is not in use, a first valve member having a fluid channel means formed therein and located in a valve housing mounted on said vapor-recovery member to be movable within said valve housing to operatively establish fluid communication between said pinch valve and said flow passage in said discharge spout, a second fluid passageway connecting said pinch valve and the flow passage in said discharge spout by way of said fluid channel means in said first valve member so that fuel may flow from said pinch valve to said flow passage in said discharge spout to open said pinch valve, said first valve member movable between a first position in which said second fluid passageway is blocked to prevent fluid communication from being established between said pinch valve and the flow passage in said discharge spout so that said pinch valve is closed and a second position in which said second fluid passageway is open by way of said fluid channel means in said first valve member to establish fluid communication between said pinch valve and the flow passage in said discharge spout so that said pinch valve is open, an actuating plunger affixed to said valve member and extending through said valve housing to contact the fuel tank fillpipe to cause said first valve member to move to the open position when said discharge spout is operatively inserted into the fillpipe and said seal means sealingly engages said vapor-recovery member, said first valve member being normally urged to the closed position when said seal means does not sealingly engage said vapor-recovery member when said nozzle is not in use, a second movable valve member having a vent channel means formed therein and located in said valve housing to be connected to said first valve member to move within said valve housing in response to the movement of said first valve member, a portion of said vent passage of said vent tube formed by said vent channel means in said second valve member such that said second valve member is movable between a first position in which said vent passage is blocked by said second valve member to disrupt normal venting and activate the vacuum-operated release mechanism to close said flow control valve when said seal means does not sealingly engage said vapor-recovery member and a second position in which said vent passage is open by way of said vent channel means to permit normal venting of the vacuum-operated release mechanism when said discharge spout is operatively inserted in the fillpipe and said seal means sealingly engages said vapor-recovery member.

14. The vapor-recovery system of claim 13 wherein the outer end of said vapor-recovery member angles outwardly toward the outlet end of said discharge spout for ease of passage through said seal means.

15. The vapor-recovery system of claim 14 further including a discharge spout sealing means secured to said vapor-recovery member rearwardly of the outer end thereof and disposed radially outwardly therefrom for sealingly engaging said seal means.

16. The vapor-recovery system of claim 15 wherein said seal means comprises a rotary seal positioned adjacent to and inwardly of a guide means which is located inwardly of the fillpipe opening for centering said vapor-recovery member in said rotary seal.

17. The vapor-recovery system of claim 15 wherein said seal means comprises a doughnut seal.

18. The vapor-recovery system of claim 15 wherein said seal means comprises a conical seal and pressure discs located outwardly of said conical seal for centering said vapor-recovery member therein, and for contacting said conical seal when said discharge spout sealing means engages said pressure discs so that said conical seal compresses to sealingly engage said vapor-recovery member.

19. A vapor-recovery fuel-dispensing nozzle for vehicle refueling for use with a vehicle fuel receiving and storage system having a fuel tank fillpipe with a seal means formed therein inwardly of the fillpipe opening for providing a vapor-tight seal to prevent the escape of vapors from the fuel tank when the nozzle is inserted into the fuel tank fillpipe during refueling, comprising:

a nozzle main body portion, a discharge spout projecting from the main body portion, said discharge spout having an outlet end proportioned for ease of insertion into the fuel tank fillpipe, a flow passage for the flow of fuel to said nozzle and through said main body portion and said discharge spout, a flow control valve in the main body portion operable to regulate the flow of fuel through said flow passage, a vapor-receiving passage formed in said nozzle main body portion, a vapor-recovery, rigid, tubular member projecting from said nozzle main body portion and coaxially arranged around said discharge spout to define with the exterior surface of said discharge spout a vapor-recovery passageway therebetween for receiving the vapors displaced from the fuel tank during refueling, said vapor-recovery member having an inner end and outer end, the inner end of said vapor recovery member mounted on said main body portion to communicate with said vapor-receiving passage in said nozzle main body portion, the outer end of said vapor-recovery member located rearwardly of the outlet end of said discharge spout and proportioned for ease of insertion into the fillpipe, said seal means receiving the outlet end of said discharge spout and the outer end of said vapor-recovery member to establish a vapor-tight seal with said vapor-recovery member when said discharge spout is operatively inserted in the fillpipe so that substantially all the vapor expelled from the fuel tank during refueling flows through said vapor-recovery member to said vapor-receiving passage in said nozzle main body portion, a valve means operable by a fluid pressure located in said vapor-recovery member inwardly of the outer end thereof to prevent the escape of vapor through the outer end of said vapor-recovery member, said valve means being in a closed position when said nozzle is not in use so that vapors located inwardly thereof cannot escape through the outer end of said vapor-recovery member and said valve means being in an open position when said discharge spout is operatively inserted into the fillpipe and said seal means sealingly engages said vapor-recovery member so that vapor expelled from the fuel tank during refueling may be directed through said vapor-recovery member to the vapor-receiving passage in said nozzle main body portion, and actuating means for operatively establishing fluid communication between the flow passage upstream of said flow control valve and said valve means so that said valve means is closed when said nozzle is not in use and for establishing fluid communication between the flow passage in said discharge spout and said valve means so that said valve means is open when said discharge spout is operatively inserted into the fillpipe and said seal means sealingly engages said vapor-recovery member.

20. The vapor-recovery system of claim 19 wherein said valve means is a pinch valve and said actuating means comprises a first fluid passageway connecting said flow passage upstream of said flow control valve with said pinch valve for flowing fuel from the flow passage upstream of said flow control valve to said pinch valve in order that a fluid pressure by supplied to said pinch valve to close said pinch valve, a first valve member having a fluid channel means formed therein and located in a valve housing mounted on said vapor-recovery member to be movable within said valve housing to operatively establish fluid communication between said pinch valve and the flow passage in said discharge spout, a second fluid passageway connecting said pinch valve and the flow passage in said discharge spout by way of said fluid channel means in said first valve member whereby fuel may flow from said pinch valve to the flow passage in said discharge spout to open said pinch valve, said first valve member movable between a first position in which said second fluid passageway is blocked to prevent fluid communication from being established between said pinch valve and the flow passage in said discharge spout so that said pinch valve is closed and a second position in which said second fluid passageway is open by way of said fluid channel means in said first valve member to establish fluid communication between said pinch valve and the flow passage in said discharge spout so that said pinch valve is open, and an actuating plunger affixed to said first valve member and extending through said valve housing to contact the fillpipe to cause said first valve member to move to the open position when said discharge spout is operatively inserted into the fillpipe and said seal means sealingly engages said vapor-recovery member, said first valve member moving to the closed position when said seal means does not sealingly engage said vapor-recovery member when said nozzle is not in use.

21. The vapor-recovery system of claim 19 wherein said nozzle further includes a vent tube extending from a vacuum-operated release mechanism to the outlet end of said discharge spout to form a vent passage therein, the vacuum-operated release mechanism automatically closing said flow control valve when the level of fuel in the fuel tank being refueled rises above a level sufficient to block the end of said vent passage of said vent tube at the outlet end of said discharge spout, a second movable valve member having a vent channel means formed therein and located in said valve housing to be connected to said first valve member to move within said valve housing in response to the movement of said first valve member, a portion of said vent passage of said vent tube formed by said vent channel means in said second valve member such that said second valve member is movable between a first position in which said vent passage is blocked by said second valve member to disrupt normal venting and activate the vacuum-operated release mechanism to close said flow control valve when said seal means does not sealingly engage said vapor-recovery member and a second position in which said vent passage is open by way of said vent channel means to permit normal venting of the vacuum-operated release mechanism when said discharge spout is operatively inserted in the fillpipe and said seal means sealingly engages said vapor-recovery member.

22. A method for recovering refueling emissions from a fuel tank of a vehicle fuel receiving and storage system wherein a fuel-dispensing nozzle cooperates with portions of the vehicle fuel receiving and storage system, the nozzle having a main body portion, a discharge spout projecting from the main body portion, said discharge spout having an outlet end proportioned for ease of insertion into a fuel tank fillpipe of the vehicle fuel receiving and storage system, a flow passage for the flow of fuel to said nozzle and through said main body portion and said discharge spout, and a flow control valve in said main body portion, comprising:

coaxially arranging a vapor-recovery, rigid, tubular member around said discharge spout to project from said main body portion to define with the exterior surface of said discharge spout a vapor-recovery passageway therebetween for receiving vapors displaced from the vehicle fuel tank during refueling, said vapor-recovery member having an inner end and outer end, the inner end of said vapor-recovery member mounted on said main body portion and communicating with said vapor-receiving passage in said main body portion, the outer end of said vapor-recovery member located rearwardly of the outlet end of said discharge spout and proportioned for ease of insertion into the fuel tank fillpipe;

locating a seal means inwardly of the fuel tank fillpipe opening to receive the outlet end of said discharge spout and the outer end of said vapor-recovery member to establish a vapor-tight seal with said vapor-recovery member when said discharge spout is operatively inserted in the fuel tank fillpipe so that substantially all the vapor expelled from the fuel tank during refueling flows through said vapor-recovery member to said vapor-receiving passage in said main body portion;

positioning a valve means operable by a fluid pressure in said vapor-recovery member inwardly of the outer end thereof to prevent the escape of vapor through the outer end of said vapor-recovery member, said valve means being in a closed position when said nozzle is not in use so that vapors located inwardly thereof cannot escape through the outer end of said vapor-recovery member and said valve means being in an open position when said discharge spout is operatively inserted into the fuel tank fillpipe and said seal means sealingly engages said vapor-recovery member so that vapor expelled from the fuel tank during refueling may be directed through said vapor-recovery member to the vapor-receiving passage in said main body portion; and providing an actuating means for operatively establishing fluid communication between the flow passage upstream of said flow control valve and said valve means so that said valve means is closed when said nozzle is not in use and for establishing fluid communication between the flow passage in said discharge spout and said valve means so that said valve means is open when said discharge spout is operatively inserted into the fuel tank fillpipe and said seal means sealingly engages said vapor-recovery member.

23. The method of claim 22 wherein said valve means is a pinch valve.

24. A method for recovering fuel emissions from a fuel tank of a vehicle fuel receiving and storage system using a fuel-dispensing nozzle wherein a seal means is formed in a fuel tank fillpipe inwardly of the opening thereof to provide a vapor-tight seal to prevent the escape of vapors from the fuel tank when the nozzle is inserted into the fuel tank fillpipe during refueling, the nozzle having a main body portion, a discharge spout projecting from the main body portion, said discharge spout having an outlet end proportioned for ease of insertion into the fuel tank fillpipe, a flow passage for the flow of fuel to said nozzle and through said main body portion and said discharge spout, a flow control valve in said main body portion operable to regulate the flow of fuel through said flow passage, and a vapor-receiving passage means formed in said main body portion, comprising:

coaxially arranging a vapor-recovery, rigid, tubular member around said discharge spout to project from said main body portion to define with the exterior surface of said discharge spout a vapor-recovery passageway therebetween for receiving the vapors displaced from the fuel tank during refueling, said vapor-recovery member having an inner end and outer end, the inner end of said vapor-recovery member mounted on said main body portion to communicate with said vapor-receiving passage in said main body portion, the outer end of said vapor-recovery member located rearwardly of the outlet end of said discharge spout and proportioned for ease of insertion into the fillpipe, said seal means being located inwardly of the fillpipe opening for receiving the outlet end of said discharge spout and the outer end of said vapor-recovery member to establish a vapor-tight seal with said vapor-recovery member when said discharge spout is operatively inserted in the fillpipe so that substantially all the vapor expelled from the fuel tank during refueling flows through said vapor-recovery member to said vapor-receiving passage in said main body portion;

positioning a valve means operable by a fluid pressure in said vapor-recovery member inwardly of the outer end thereof to prevent the escape of vapor through the outer end of said vapor-recovery member, said valve means being in a closed position when said nozzle is not in use so that vapors located inwardly thereof cannot escape through the outer end of said vapor-recovery member and said valve means being in an open position when said discharge spout is operatively inserted into the fillpipe and said seal means sealingly engages said vapor-recovery member so that vapor expelled from the fuel tank during refueling may be directed through said vapor-recovery member to the vapor-receiving passage in said main body portion; and providing an actuating means for operatively establishing fluid communication between the flow passage upstream of said flow control valve and said valve means so that said valve means is closed when said nozzle is not in use and for establishing fluid communication between the flow passage in said discharge spout and said valve means so that said valve means is open when said discharge spout is operatively inserted into the fillpipe and said seal means sealingly engages said vapor-recovery member.

25. The method of claim 24 wherein said valve means is a pinch valve.

* * * * *